US005536210A

United States Patent [19]

Barber

[11] Patent Number: 5,536,210

[45] Date of Patent: Jul. 16, 1996

[54] AMUSEMENT APPARATUS

[76] Inventor: Jerry L. Barber, 410 Hudson Rd., Greenville, S.C. 29615

[21] Appl. No.: 187,839

[22] Filed: Jan. 28, 1994

[51] Int. Cl.[6] ..... A63G 31/00

[52] U.S. Cl. ..... 472/128; 104/58; 254/93 HP; 4/491

[58] Field of Search ..... 472/85, 92, 128, 472/137, 88; 405/79; 4/491; 254/93 HP; 104/58

[56] References Cited

U.S. PATENT DOCUMENTS

| | | | |
|---|---|---|---|
| 586,983 | 7/1897 | Wharton, Jr. . | |
| 694,447 | 3/1902 | Kannel . | |
| 871,744 | 11/1907 | Kannel . | |
| 953,724 | 4/1910 | Kannel . | |
| 1,357,995 | 11/1920 | Kitterman . | |
| 1,517,589 | 12/1924 | Scott . | |
| 1,701,842 | 2/1929 | Fisch | 472/128 X |
| 3,142,908 | 8/1964 | Annis et al. | 472/128 X |
| 3,473,334 | 10/1969 | Dexter | 472/128 X |
| 3,562,823 | 2/1971 | Koster | 472/128 X |
| 3,913,332 | 10/1975 | Forsman | 405/79 |
| 3,964,316 | 6/1976 | Abe | 472/128 X |
| 4,061,310 | 12/1977 | Vetter | 254/93 HP |
| 4,062,192 | 12/1977 | Biewer . | |
| 4,063,517 | 12/1977 | Nardozzi | 104/58 X |
| 4,142,258 | 3/1979 | Schiron | 472/128 X |
| 4,976,570 | 12/1990 | Davis et al. . | |

*Primary Examiner*—Carl D. Friedman
*Assistant Examiner*—Beth A. Aubrey

[57] ABSTRACT

An amusement apparatus comprising an elongated flume which has a fluid medium provided therein. A plurality of passenger vehicles are carried in the flume. Lifting mechanisms are provided for selectively raising and lowering various areas of the flume causing the fluid medium to travel as a wave in a continuous path around the flume and propel passenger vehicles floated thereon.

9 Claims, 5 Drawing Sheets

AMUSEMENT APPARATUS

BACKGROUND OF THE INVENTION

This invention relates to an amusement apparatus wherein patrons are loaded into vehicles in the form of circular tubs and are propelled around a flume by a wave of water responsive to tilting the flume in a circular motion.

There are many amusement rides incorporating vehicles which are transported around a predetermined path responsive either to self-propulsion as is the case when using small boats or by mechanical mechanisms. On many children rides, vehicles such as small boats are attached to a track which has a chain running therethrough for pulling the boats around a circular path.

There have been attempts to create wave motions in the amusement apparatus and one such device is disclosed in U.S. Pat. No. 694,447 granted on Mar. 4, 1902. Another type of roundabout sailing apparatus is disclosed in U.S. Pat. 1,357,995 wherein sailboats are caused to travel over a body of water and are adapted for sailing on an elongated course in a manner simulating the passing of boats up and down a stream instead of in a circular path as is usual in the practical application of aquatic carousals. Still other amusement apparatuses are disclosed in U.S. Pat. Nos. 871,744 and 953,724.

Apparatuses and methods for generating waves in a body of water are disclosed in U.S. Pat. Nos. 4,976,570, 586,983, and 4,062,192.

Accordingly, it is an important object of the present invention to provide an amusement apparatus wherein vehicles such as floatable carriers are propelled around a mote by a moving wave.

Still another important object of the present invention is to provide an amusement apparatus wherein by imparting a circular wobbling motion to a flume, a body of water is moved continuously around the flume in the form of a wave to propel passenger vehicles.

Still another important object of the present invention is to provide a simple and enjoyable amusement apparatus wherein patrons can be readily loaded into carriers and removed from carriers and transported around a flume by a moving body of water.

SUMMARY OF THE INVENTION

According to the present invention, the above objects are accomplished by utilizing an endless flume defined by opposed side walls which are joined by a bottom wall that has a fluid medium provided therein. A plurality of passenger vehicles are carried on the flume. A lifting device is operably connected to the flume for selectively raising and lowering consecutive areas of the flume. Activating mechanisms are connected to the lifting devices for raising and lowering the areas of the flume, causing the fluid medium to travel as a wave in a continuous path around the flume. The wave engages the carriers positioned within the flume and transports the carriers around the flume.

DESCRIPTION OF THE PREFERRED EMBODIMENT

Figure 1:
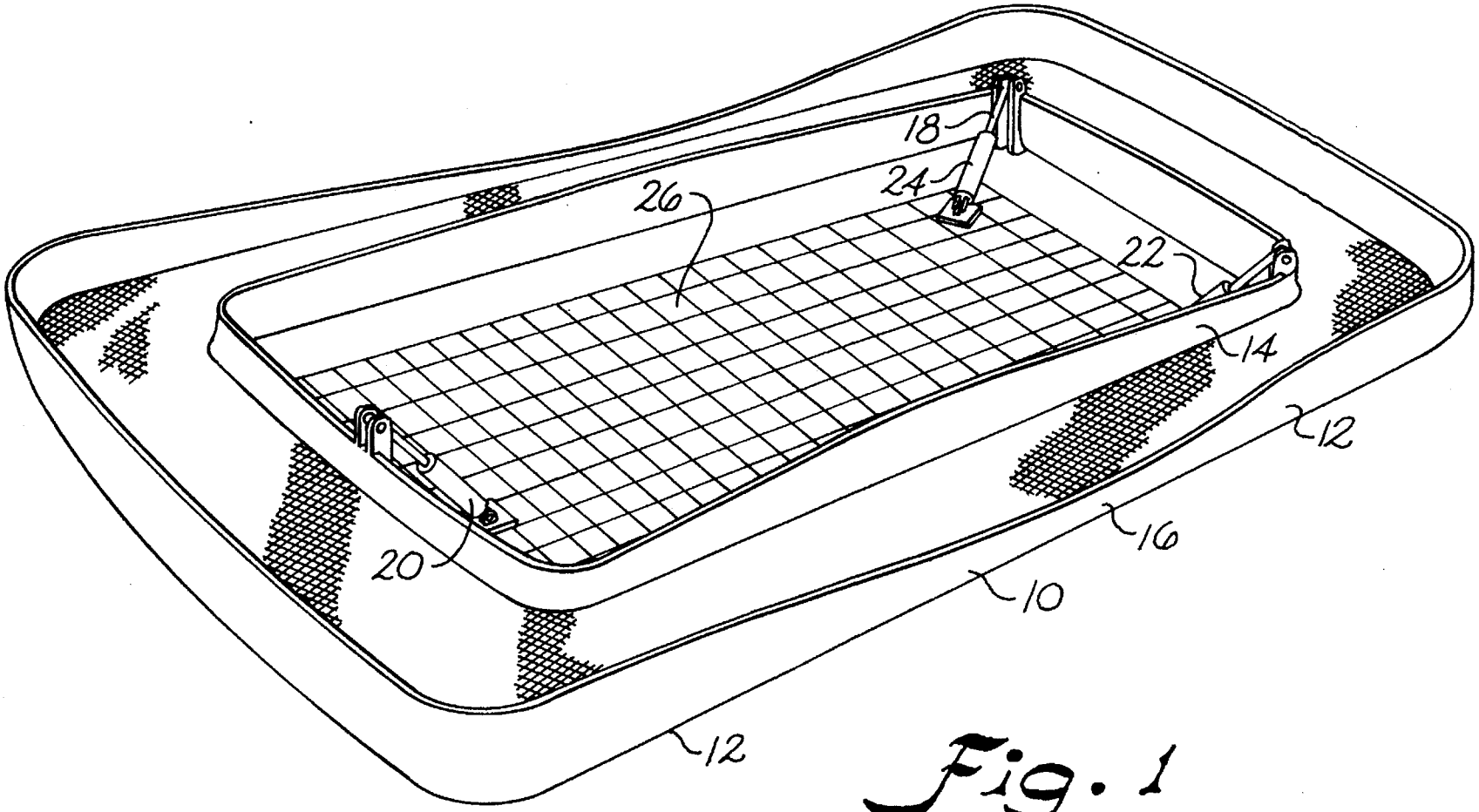
FIG. 1 is a perspective view of an amusement apparatus constructed in accordance with the present invention without water or passenger vehicles carried thereon.

Referring to FIG. 1 of the drawings, there is illustrated an amusement apparatus constructed in accordance with the present invention. The apparatus includes a substantially rectangular shaped flume 10 that is defined by a pair of opposed side walls 12 and 14 that are joined by a rigid bottom 16. The flume is supported on pistons 18 extending out of the end of three spaced hydraulic cylinders 20, 22 and 24. The lower ends of the hydraulic cylinders 20, 22 and 24 are anchored in a rigid structure such as the ground or a concrete base 26. If the amusement apparatus is designed to be a portable apparatus, then the base could be constructed of any suitable rigid material so that it could be removed and transported. The important thing is to provide sufficient strength in the base 26 to support the hydraulic cylinders 20, 22 and 24 along with the flume 10.

Figure 2:
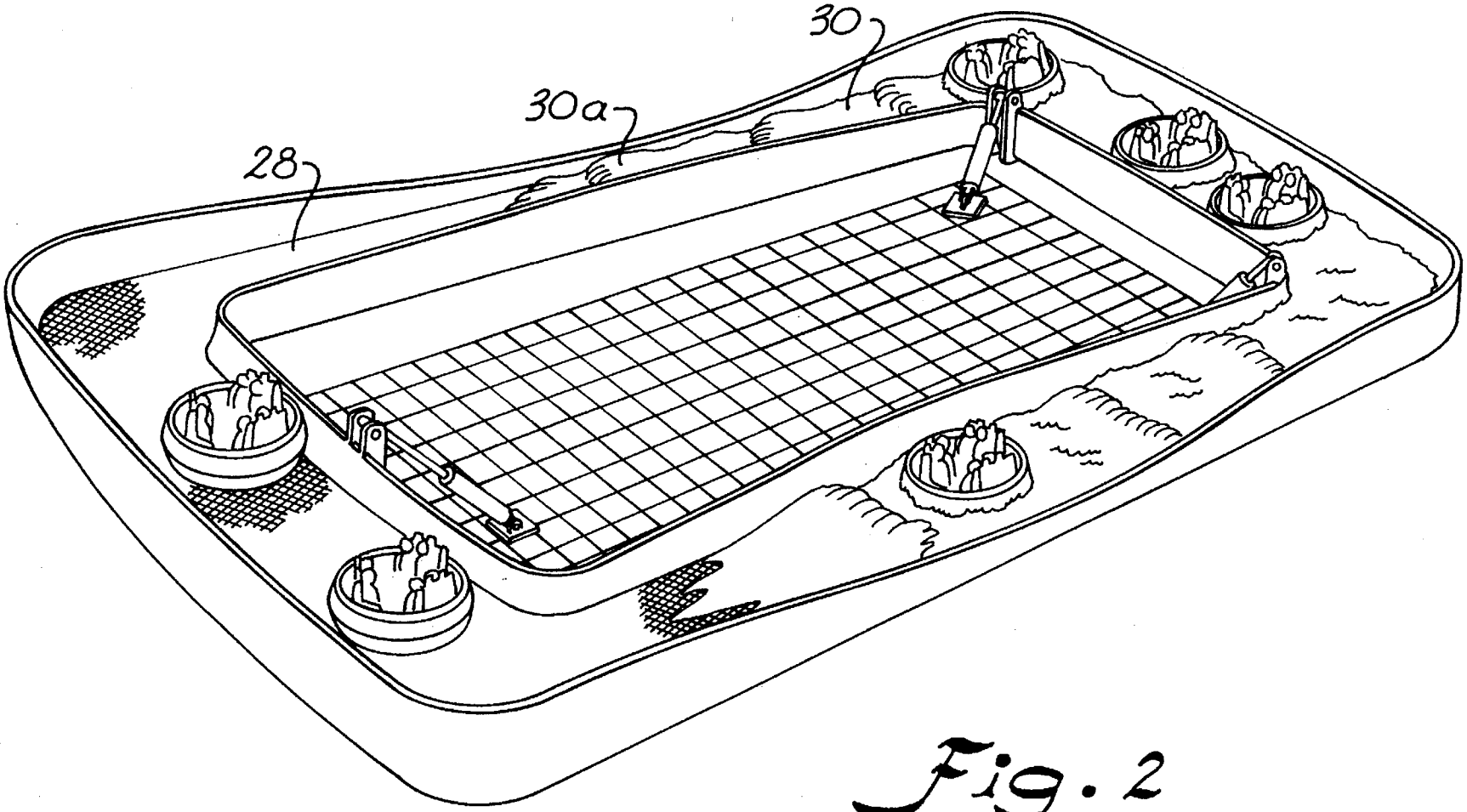
FIG. 2 is a perspective view of the amusement apparatus showing the flow of water and passenger vehicles contained therein.
Figure 3:
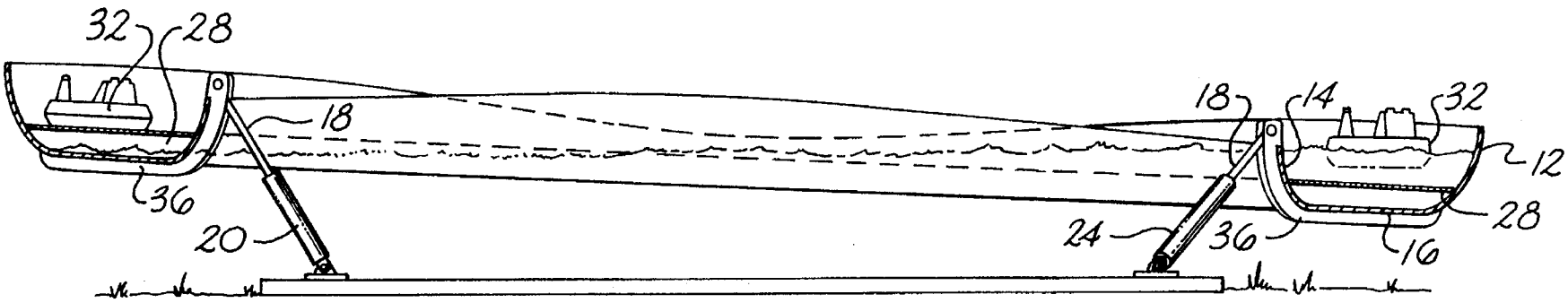
FIG. 3 is a sectional view illustrating the amusement apparatus tilted at one particular orientation.
Figure 4:
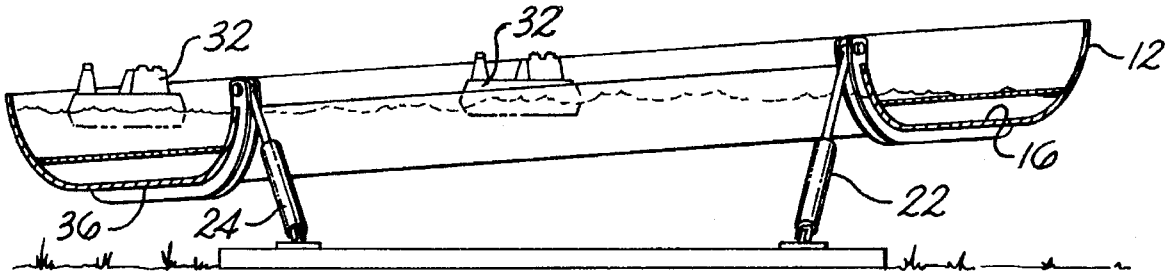
FIG. 4 is an end cross sectional view illustrating the amusement apparatus tilted in a second position.

As can be seen in FIG. 2, the flume has an expanded metal floor 28 carried therein which is spaced a predetermined distance from the bottom wall 16 of the flume. Water 30 is positioned in the flume and the level of water is such to cause waves to be moved around the flume when the flume is moved in a wobbling, circular motion. As can be seen in FIGS. 3 and 4, the level of the water extends above the expanded metal floor 28 to float carriers 32 when the flume 10 is tilted. When the entire flume is held in a level position, the water just barely extends above the expanded floor 28 and as a result, there is not sufficient bounce to support the passenger vehicles 32 and they rest on the expanded metal floor.

This level position of the flume is desirable when loading and unloading passengers from the carriers 32.

It is to be understood, of course, that the expanded floor 28 is not necessary and if desired, it can be removed and the water level within the flume can be lowered. The carriers would then rest on the bottom of the flume when the flume is held in the level position.

Figure 8:
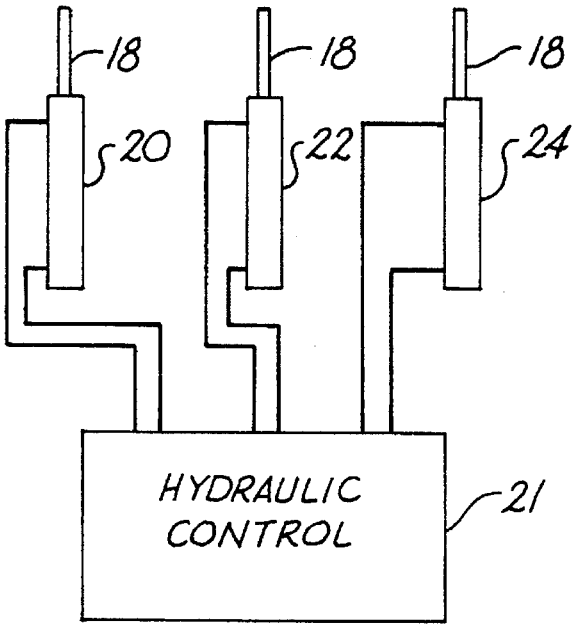
FIG. 8 is a schematic diagram illustrating a control system for controlling the activation of the hydraulic cylinders of FIG. 2.

FIG. 8 discloses the tilting devices for the flume 10 which include the hydraulically operated cylinders 20, 22 and 24. The hydraulic cylinders 20, 22 and 24 are double-acting cylinders and any suitable conventional control system 21 which includes hydraulic pumps can be used for selectively supplying hydraulic fluid to the bottom ends of the cylinders 20, 22 and 24 for extending the pistons 18 from the cylinders in a predetermined sequence. By sequentially supplying fluid to the bottoms of each of the cylinders 20, 22 and 24 and sequentially supplying hydraulic fluid to the upper ports of the cylinders 20, 22 and 24, the flume can produce a continuous wobbling motion as a result of a moving raised area of the flume being positioned above the rest of the flume. This raised area progresses around the flume so that the water in the flume will be displaced to the lower portion of the flume.

As can be seen in FIG. 2, as the hydraulic cylinders are sequentially activated to shift the high spot of the flume around the periphery of the flume such causes the water to move in the form of a wave 30 to the lowest part of the flume. The moving wave 30a lifts the carriers 32 with its leading edge to float the carrier 32 forward around the flume. The carrier is floated by the leading edge of the wave until it strikes a carrier resting on the expanded metal floor 28. At this point in time, the wave then lifts the carrier being struck onto the leading edge of the wave, and the carrier that was on the leading edge of the wave is displaced rearwardly on the moving body of water. The vehicles carried on the trailing edge of the moving body of water will be deposited on the expanded metal floor 28 as a result of the body of water moving forward faster than the movement of the vehicle and also as a result of the vehicles striking each other as the body of water moves forward around the flume.

As can be seen in FIGS. 3 and 4, the outer ends of the pistons 18 are connected to a cradle-like structure 36. The cradle-like structure 36 may be constructed of any suitable material such as steel as long as it has sufficient strength to support the flume. The bottom surface 16 of the flume rests on the cradle-like structure 36 so that when the cradle 36 is raised, it will raise the flume therewith.

Figure 5:
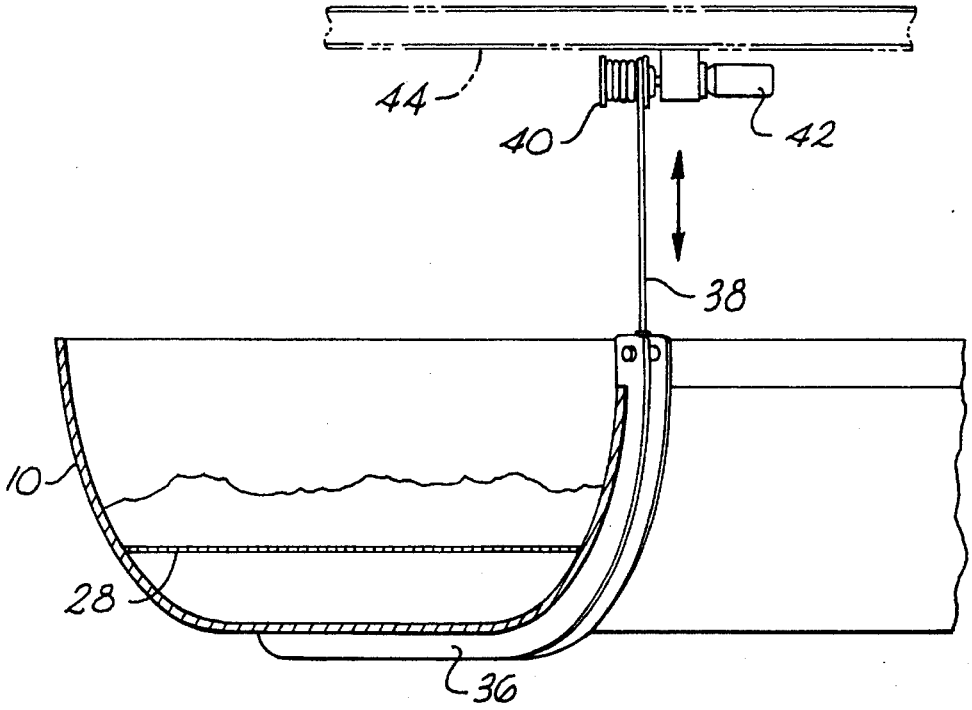
FIG. 5 is a sectional view illustrating a modified form of the invention utilizing a mechanism for raising and lowering a particular area of the flume.

The various areas of the flume can be raised and lowered to produce a wobbling motion to the flume with mechanisms other than the hydraulically operated cylinder. As shown in FIG. 5, the flume can be supported by cables 38 carried on the end of a wench 40 that is driven by a motor 42. By selectively rotating the motor 42 in one direction and then in the opposite direction, the area of the flume located directly therebelow, that is supported on the cradle 36, can be raised and lowered. It would require at least three of such motors and wenches 42 and 40 strategically positioned around the flume for raising and lowering the flume. The sequence in which the areas of the flume would be raised and lowered would be under control of any suitable conventional control system for activating the motors. The motors 42 and the wenches 40 are supported on an overhead beam 44.

Figure 6:
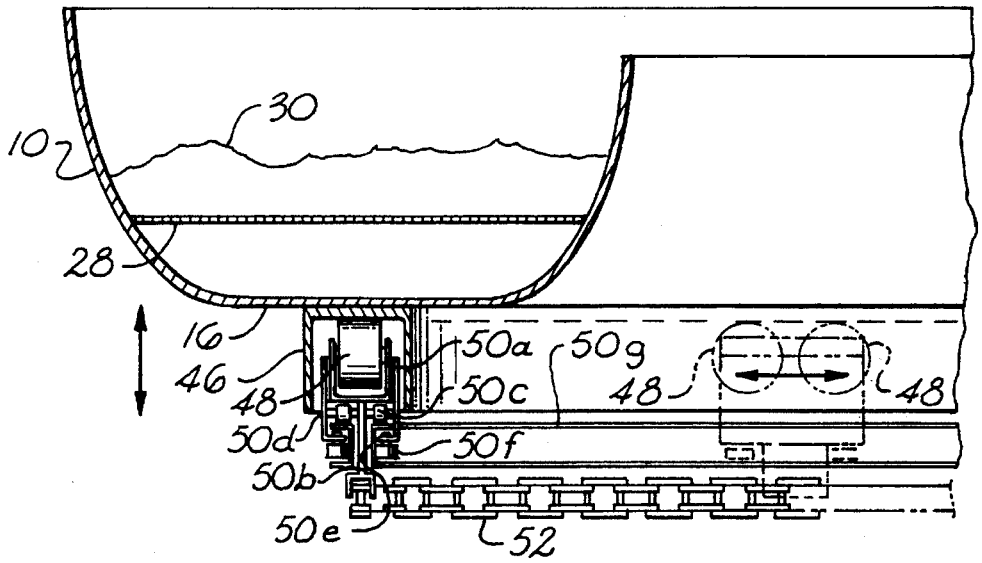
FIG. 6 is a modified form of the invention showing another mechanism for raising and lowering various areas of the flume.

In FIG. 6, there is illustrated still another device that can be used for raising and lowering the flume. A channel member 46 is secured to the bottom surface 16 of the flume. Rollers 48 carried within a bearing 50 are driven by means of an elongated chain 52 in a path along the bottom surface of the flume. The area of the flume 16 directly above the rollers 48 is raised by the rollers passing therebeneath while the area on the opposite side of the flume is lowered.

If the chain driven rollers 48 are used on a flume such as shown in FIG. 1, then its path would be more or less rectangular rather than circular. The chains could be driven by any suitable mechanisms such as a motor. Several sets of rollers 48 could be positioned on the chain, each one projecting above the run of the chain a predetermined height so that as the chain is rotated, the bottom of the flume is raised and lowered according to the heights of the rollers 48 which would in turn impart a wobbling motion to the flume to produce the moving wave 30*a* which would travel in a circular motion around the flume. The rollers 48 are supported for rotation in a U-shaped bracket 50*a*. The U-shaped bracket 50*a* is in turn supported on a shaft 50*b* that has its lower end attached to the chain 52. The bracket 50*a* has fixed to it angles 50*d* which have bearings 50*c* attached thereto. Bearings 50*c* are also attached to shaft 50*b*. Bearings 50*c* ride a top surface of channel member 50*g*. At the lower end of the channel members 50*d* are flanges 50*e* which support rollers 50*f* that prevent sideward motion of the rollers 48 as they are propelled by the chain.

Figure 7:
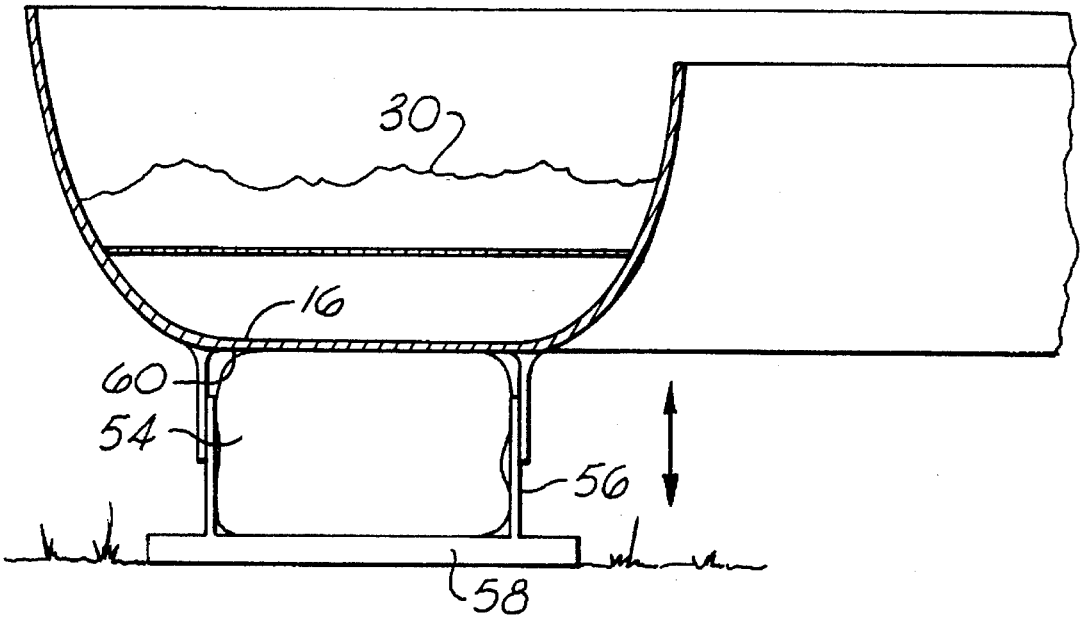
FIG. 7 is still another modified form of the invention illustrating bladders for raising particular areas of the flume.

FIG. 7 discloses still another mechanism for raising and lowering the flume to impart a wobbling motion thereto. In FIG. 7, there is disclosed a bladder 54 that is carried within a channel 56 supported on a base member 58. An upper surface of the bladder 60 engages the bottom wall 16 of the flume. There would be at least three bladders equally spaced about the bottom surface of the flume for imparting the wobbling motion to the flume. The bladders 60 in one particular embodiment would be pneumatic bladders and air would be supplied to and removed from the bladders in sequence so as to raise the flume in one area and lower it in another in a cyclic pattern so as to produce a wobbling action. The wobbling action would be the same as described above in connection with the device of FIGS. 1 through 4. Such in turn would shift water carried within the flume to move as a surging wave continuously around the flume for lifting and propelling passenger vehicles thereabove.

While the preferred embodiments and the invention has been described using specific terms, such description is for illustrative purposes only, and it is to be understood that changes and variations may be made without departing from the spirit or scope of the following claims.

What is claimed is:

1. An amusement apparatus comprising:

an endless flume defined by opposed side walls joined by a rigid bottom, said flume defining a continuous endless fluid path, fluid medium carried within said flume, a plurality of floatable passenger carriers carried in said flume, said passenger carriers travelling in a single direction around said endless fluid path, and tilting devices operably connected to said flume in a predetermined spaced apart relation, said tilting devices alternately raising and lowering said flume in a predetermined sequence so that a said fluid medium carried within said flume moves around said flume in said continuous endless fluid path for selectively floating and moving said passenger carriers in a single direction around said fluid path.

2. The amusement apparatus as set forth in claim 1 wherein said tilting devices are hydraulically operated cylinders.

3. The amusement apparatus as set forth in claim 1 wherein said tilting devices comprise a plurality of inflatable bags positioned beneath said flume, and means for selectively inflating said bags for alternately raising and lowering areas of said flume.

4. The amusement apparatus as set forth in claim 1 wherein said tilting devices comprises:

a bearing member engaging a lower surface of said bottom of said flume, and a drive mechanism for moving said bearing member in a circular motion for raising the portion of said flume directly thereabove for moving said fluid medium around said flume.

5. An amusement apparatus comprising:

an endless flume defined by opposed side walls joined by a bottom wall, said flume defining a continuous endless fluid path, fluid medium carried within said flume, a plurality of passenger vehicles carried in said flume, said passenger vehicles travelling in a single direction around said endless fluid path, a lifting device operably connected to said flume for selectively raising and lowering areas of said flume, activating mechanism connected to said lifting device for raising and lowering said areas of said flume causing said fluid medium to travel as a wave in a continuous path around said flume, and said passenger vehicles being propelled by said wave around said fume in said single direction.

6. The amusement apparatus as set forth in claim 5 wherein said flume has a rigid bottom.

7. The amusement apparatus as set forth in claim 5 wherein said lifting device includes a plurality of spaced apart hydraulic cylinders.

8. The amusement apparatus as set forth in claim 5 wherein said lifting device includes a driven roller engaging a bottom portion of said flume for raising and lowering areas of said flume to cause said wave to move in a continuous path around said flume.

9. The amusement apparatus as set forth in claim 5 wherein said lifting device includes a plurality of inflatable bladders.

* * * * *